United States Patent [19]

Hudspeth et al.

[11] 4,060,781

[45] Nov. 29, 1977

[54] WAVEGUIDE SWITCH

[75] Inventors: Thomas Hudspeth, Malibu; Harmon H. Keeling, Los Angeles, both of Calif.

[73] Assignee: Hughes Aircraft Company, Culver City, Calif.

[21] Appl. No.: 723,879

[22] Filed: Sept. 16, 1976

[51] Int. Cl.[2] ..... H01P 1/10; H01P 1/16; H01P 5/12; H01P 1/17

[52] U.S. Cl. ..... 333/98 S; 333/21 A; 333/21 R

[58] Field of Search ..... 333/98 R, 97 R, 98 S, 333/98 M, 98 TN, 21 R, 21 A, 27, 1, 31 A; 343/756

[56] References Cited

U.S. PATENT DOCUMENTS

| | | | |
|---|---|---|---|
| 2,438,119 | 3/1948 | Fox | 333/98 X |
| 2,443,612 | 6/1948 | Fox | 333/27 |
| 2,513,334 | 7/1950 | Kirkman et al. | 333/98 X |
| 3,142,061 | 7/1964 | Allen | 343/756 X |
| 3,622,921 | 11/1971 | Heeren | 333/21 A |

OTHER PUBLICATIONS

Southworth–"Principles and Applications of Waveguide Transmission" D. Van Nostrand, New York, 1961; title page and pp. 327–335.

*Primary Examiner*—Alfred E. Smith
*Assistant Examiner*—Marvin Nussbaum
*Attorney, Agent, or Firm*—Rafael A. Cardenas; W. H. MacAllister

[57] ABSTRACT

A simplified waveguide switch is disclosed having a rotatable quarter wave plate for generating selected amounts of right hand and left-hand circular polarized waves. A linearly polarized signal, in the $TE_{11}$ mode, is launched into a cylindrical waveguide member. A quarter-wave plate is disposed within the cylindrical waveguide and imparts a right or left-hand circular polarization to the linear wave depending upon the orientation of the quarter wave plate with respect to the linear wave. The rotation angle of the quarter wave plate is adjusted by a stepping motor.

7 Claims, 5 Drawing Figures

WAVEGUIDE SWITCH

BACKGROUND OF THE INVENTION

1. Field of the Invention

The invention relates generally to switches and in particular the invention relates to microwave switches.

DESCRIPTION OF THE PRIOR ART

Microwave switches are generally known in the prior art. A particular use for such switches is for selectively generating various combinations of right and left-hand circular polarized waves. The polarized waves are applied to directional filters which then direct the right-hand wave to a first antenna system while the left-hand waves are directed to another antenna system.

Microwave switches such as the Faraday rotator are also well known in the prior art. The Faraday rotator includes a rotator section for rotating the plane of polarization of the linear signal and a quarter wave plate for generating predetermined amounts of right hand and/or left-hand circular polarized waves.

The rotator section is made up of a cylindrical waveguide member having an input port to which a linearly polarized wave is applied. A ferrite rod is axially suspended within the cylindrical waveguide and a coil is mounted about the outer circumference of the waveguide, coaxial with the ferrite rod. As current is applied to the coil, a magnetic field is induced in the ferrite rod which causes the plane of polarization of the linear wave to be rotated in an angle and sense or direction which is proportional to the current applied.

The linear signal having its plane of polarization rotated is then applied to another cylindrical waveguide member having a quarter-wave plate therein for generating right-hand and left-hand circular polarized waves. Thus, the ratio of right-hand to left-hand circular polarized waves is determined by the current applied to the coil.

The Faraday rotator is relatively bulky, heavy and requires continuous power to maintain a particular angle of the plane of polarization of the linear wave. In addition, the output signal of the Faraday rotator is temperature sensitive. For example, environmental temperature changes cause the permeability of the ferrite rod to vary which in turn varies the plane of polarization of the linearly polarized wave. Thus, as the temperature changes so does the ratio of right-hand to left-hand polarization waves.

Another method of rotating the linear polarization of a wave is to use an electrically rotated quarter-wave plate. This method uses a ferrite tube in a circular waveguide having a quadrupole field around the waveguide. The ferrite tube is transversely magnetized by the quadrupole magnetics to rotate the plane of polarization of the input wave. Also, an A/C motor stator arrangement may be used in place of the quadrupole arrangement for electrically rotating the magnetic field about the waveguide. The drawbacks of such an arrangement is that such a device is heavy, "lossy", and in addition, requires a holding current.

SUMMARY OF THE INVENTION

Accordingly, it is an object of the present invention to provide a simplified, reliable, and accurate microwave switch.

It is another object of the present invention to provide a microwave switch that is very insensitive to temperature changes.

It is another object of the present invention to provide a microwave switch which requires little power to operate and no power to maintain a state.

It is yet another object of the present invention to provide a microwave switch that is light in weight and not bulky.

It is still another object of the present invention to provide a microwave switch which has little loss.

In accordance with the above objects a microwave switch includes a waveguide member having an input and an output. A rotatable quarter-wave plate is disposed within the waveguide member and is selectively rotated by rotating means. Input means launch a linearly polarized wave into the waveguide member. The linear input signal is then applied to the quarter-wave plate for generating right and left-hand circularly polarized wave in a ratio that is determined by the angle of rotation of the quarter wave plate.

BRIEF DESCRIPTION OF THE DRAWINGS

FIG. 4*a* is a vector diagram illustrating an E vector rotating in space.

FIG. 4*b* is a vector diagram of the horizontal and vertical components of an E vector rotating in space.

DETAILED DESCRIPTION OF THE DRAWINGS

Figure 1:
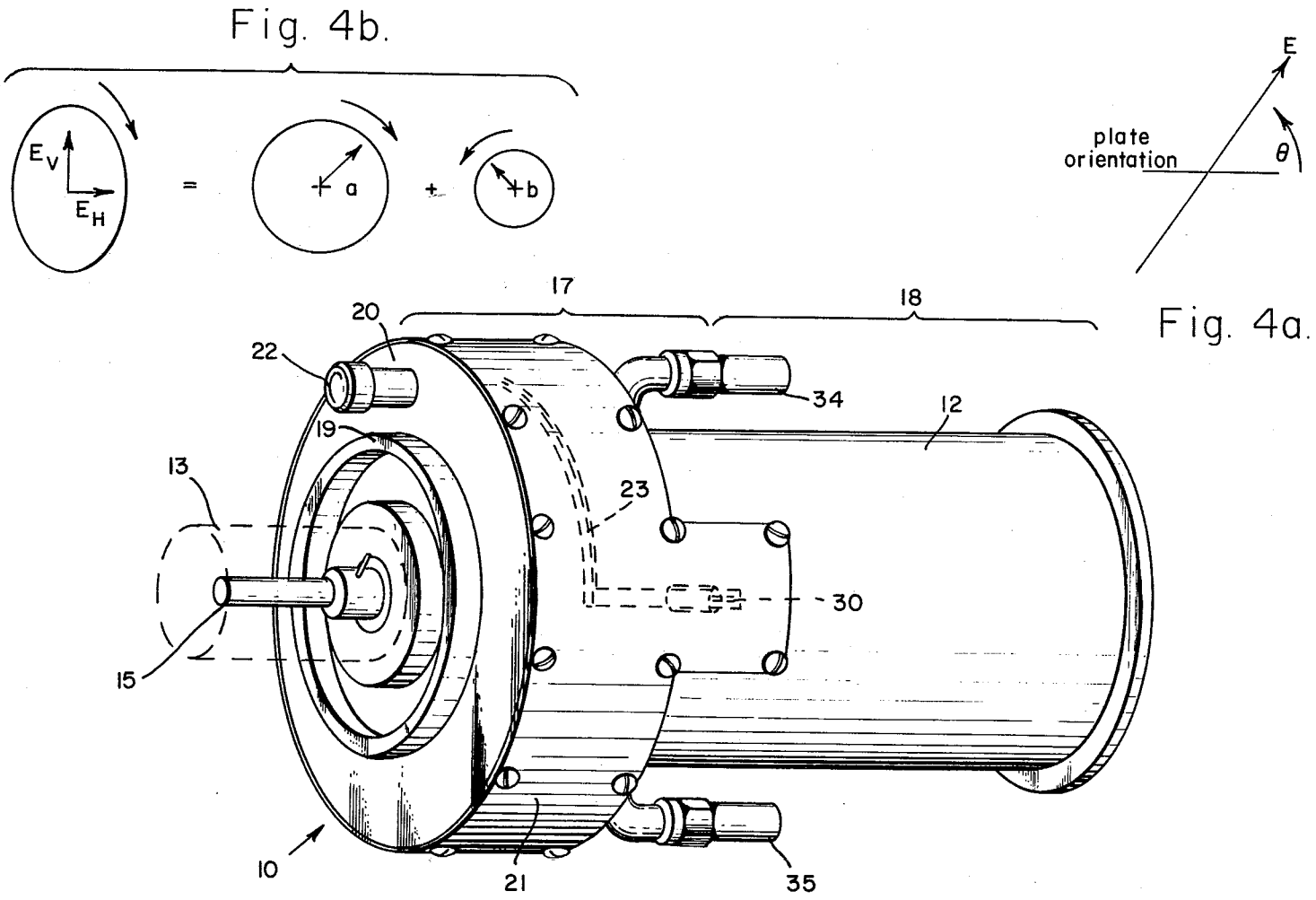
FIG. 1 is a perspective view of one embodiment of the invention.

Referring now to FIG. 1, an embodiment of the microwave switch 10 includes a cylindrical waveguide 12 having a stepping motor 13 mounted at one end. A rotatable quarterwave plate (not shown here) is disposed at the other end of the waveguide member 12 and is selectively rotated through a rod 15. The stepping motor 13 may be any suitable bi-directional, two phase motor having low torque. A low torque motor may be used since the rod and quarter-wave plate have little inertia.

The waveguide member 12 is closed at the input section 17 and open at the output section 18. A plate 19 shorts one side of the input section 17 and provides a mounting for the stepping motor 13. The plate 19 also provides a bearing surface for the rod 15.

A coaxial housing member 20 and a housing cover 21 are mounted about the input section 17 of the cylindrical waveguide member 12. The housing 20 contains a "Squarax" coaxial conductor 23 for supplying the linearly polarized signal. An input port, illustrated here as a coaxial connector 22 is mounted to the coaxial housing member 20. A portion of the coaxial conductor 23 is shown in phantom as being attached to the input connector 22. One end of the coaxial conductor 23 is attached to a probe 30 which extends into the interior of the waveguide member 12. The other end of the conductor 23 terminates in a probe 31, not shown here.

Figure 2:
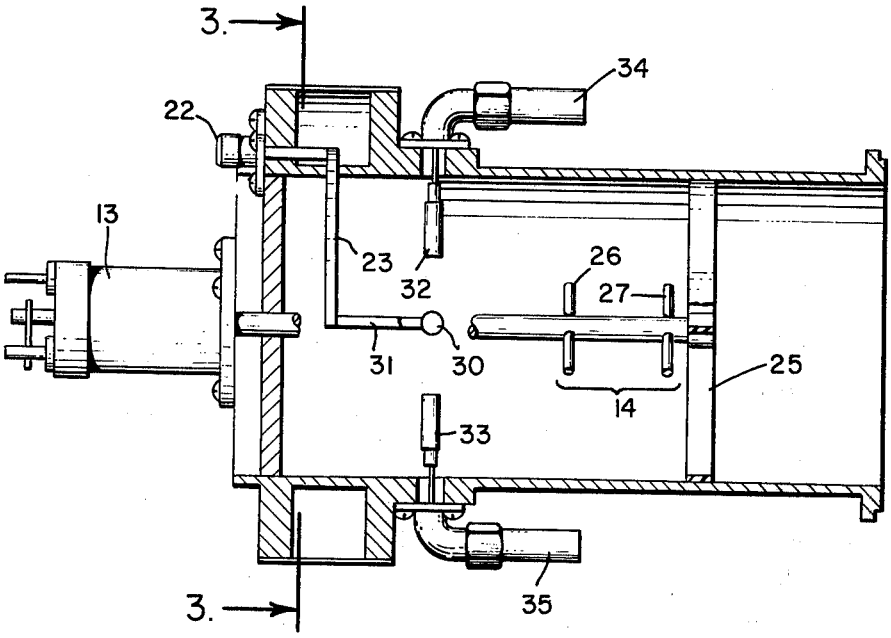
FIG. 2 is a longitudinal sectional view of the embodiment according to FIG. 1.

Referring now to FIG. 2, the cross sectional view depicts the invention in greater detail. One end of the coaxial conductor 23 terminates in a probe 30 which extends through the wall of the waveguide member 12. The other end, not shown here, also terminates in a probe 31 which extends into the waveguide member 12. It is noted that the distance from the input connector 22 to the first probe 30 is one half a wavelength less than the distance from the connector 22 to the other probe 31. The two probes 30 and 31, in conjunction with each other, generate a linearly polarized signal which is launched into the waveguide 12 as a $TE_{11}$ mode. In order to have such a signal, the probes 30 and 31 must be electrically 180° out of phase with each other so that current flowing into one of the probes will be flowing out of the other. It is also noted that a third probe 32 extends into the waveguide 12. A fourth probe 33 also extends into the waveguide 12 and is in diametric opposition to the third probe 32. The probes 32 and 33 are for impedance matching purposes and both terminate in loads 34 and 35 respectively. The probes 32 and 33 and the loads 34 and 35 provide a termination for any linearly polarized signal which may be reflected to them and which is aligned with two probes 32 and 33.

The quarter-wave plate 14 is suspended within waveguide housing 12 by the dielectric rod 15, one end of which is supported by the plate 19 at the rear of the waveguide 12. The other end of the rod 15 is supported by a dielectric support ring 25. Both the rod 15 and the support ring 25 are made of a dielectric material such as Rexolite, a product of American Enka Corporation. A dielectric material is used so that it would not interfere with the propagation of the waves through the waveguide member 12.

It is noted that the quarter-wave plate 14 is actually two coplanar metallic rods 26 and 27, which plane is oriented orthogonally to the direction of wave propagation within the wavequide member 12. The rods 26 and 27 are less than one-half wavelength long and are spaced approximately one-eighth apart. A rod which is greater than one-half wavelength would be inductive and would not be practical to use because it would be more frequency sensitive. A rod less than one-half wavelength provides capacitive susceptance and by adjusting the length, the correct amount of susceptance may be arrived at. Two rods are used to cancel the mismatch to reduce the voltage standing wave ratio (VSWR). The second rod also provides additional phase delay to the waves that are polarized in the plane of the rods. Other quarter-wave plates may be used such as metal or dielectric plates, but these may not provide the performance of the coplanar rods. Generally, a solid quarter-wave plate would be longer than the two rods alone.

Figure 3:
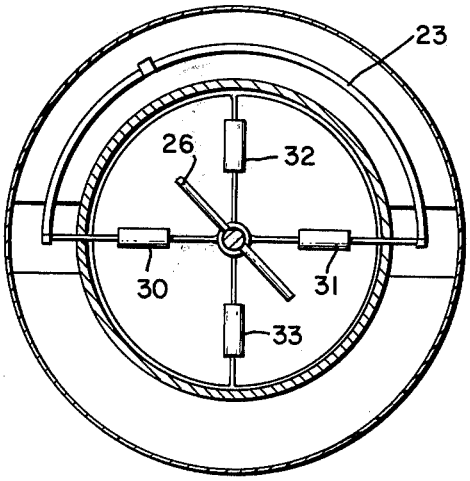
FIG. 3 is cross sectional view of the embodiment according to FIG. 1.

Referring briefly to FIG. 3, the view illustrates the interior of the polarizer section 12. The active probes 30 and 31 extend into the waveguide 12 and are 180° apart in position. The impedance matching probes 32 and 33 are also located 180° apart and 90° from the active probes. The support ring 25 consists of two concentric rings held together by support rods.

Referring to FIG. 4, the operation of the quarter-wave plate is now illustrated. FIG. 4*a* illustrates the direction of the E field and the orientation of the quarter-wave plate 14. Relative to the plate 14, the linearly polarized field may be resolved into horizontal and vertical components given by $$E_H = E \cos \theta, \text{ and}$$

$$E_V = E \sin \theta.$$

The quarter-wave plate delays the $E_H$ 90° with respect to $E_V$ resulting in an elliptically polarized field. This field may be resolved into orthogonal circularly polarized components as shown in FIG. 4*b*. Since $$a + b = E_V = E \sin \theta$$

$$a - b = E_H = E \cos \theta$$

Then $$a = E/2 (\sin \theta + \cos \theta)$$

$$b = E/2 (\sin \theta - \cos \theta)$$

The relative output power distribution is given by $$\text{CP mode 1} = a^2 = E^2/4 [1 + \sin (2\theta)]$$

$$\text{CP mode 2} = b^2 = E^2/4 [1 - \sin (2\theta)]$$

$$\text{Total power} = a^2 = b^2 = E^2/2.$$

Although the present invention has been shown and described with reference to a particular embodiment, nevertheless, various changes and modifications obvious to one skilled in the art to which the invention pertains are deemed within the purview of the invention.

What is claimed is:

1. An improved microwave switch for generating circularly polarized waves in response to linear waves, comprising:

waveguide means being cylindrically shaped, having an aperture and having a closed end;

input probe means being radially mounted within said waveguide means and comprising first and second probes being disposed 180 degrees to each other for generating linear waves having a first polarity;

quarter-wave plate means rotatably disposed within said waveguide means between said input probe means and said aperture for generating selected right and left hand circular polarized waves in response to said linear waves; and rotating means coupled to said quarter-wave plate means.

2. The invention according to Claim 1, comprising:

said waveguide being a cylindrical member having first and second ends, said first end being closed; and said input means being located at said closed end of said cylindrical member and being first and second probes extending radially into said cylindrical member and being 180° to each other for providing a linearly polarized signal.

3. The invention according to claim 2 wherein said rotatable quarter-wave means comprises:

first and second coplanar conductive rods for providing a predetermined susceptance and whose plane is rotatable about the axis of said cylindrical member.

4. The invention according to claim 3 comprising:

said first and second coplanar rods being spaced substantially one-eighth of a wavelength apart.

5. The invention according to claim 3 wherein said rotating means comprise:

a stepping motor;

rotating rod connected to said stepping motor and to said rotatable quarter-wave means;

support means disposed within a cylindrical member for supporting said rotating rod.

6. An improved microwave switch for generating circularly polarized waves in response to linear waves, comprising:

waveguide means being cylindrically shaped, having an aperture and having a closed end;

input probe means being radially mounted within said waveguide means and comprising first and second probes being disposed 180° to each other for generating linear waves having a first polarity;

quarter-wave plate means rotatably disposed within said waveguide means between said input probe means and said aperture for generating selected right and left hand circular polarized waves in response to said linear waves;

rotating means coupled to said quarter-wave plate means;

first support means for coupling said rotating means and said quarter-wave plate means and for supporting said quarter-wave plate means; and second support means for supporting said first support means.

7. An improved microwave switch according to claim 6 comprising:

said first support means being a dielectric rod;

said second support means being a dielectric ring coupling to said first dielectric rod and having radially disposed support members for holding said dielectric rod axially aligned with said cylindrical waveguide means.

* * * * *